United States Patent [19]

Armbruster

[11] Patent Number: 4,817,483

[45] Date of Patent: Apr. 4, 1989

[54] ELECTRICALLY POWERED DISPENSER FOR ROLLED SHEET MATERIAL HAVING A ROTARY BLADE CUTTER

[76] Inventor: Joseph M. Armbruster, 2700 NE. 47th St., Lighthouse Point, Fla. 33064

[21] Appl. No.: 71,088

[22] Filed: Jul. 8, 1987

[51] Int. Cl.[4] ..... B65H 75/32

[52] U.S. Cl. ..... 83/488; 83/614; 83/649

[58] Field of Search ..... 83/205, 487, 488, 649, 83/614, 650, 455, 456

[56] References Cited

U.S. PATENT DOCUMENTS 3,529,504 9/1970 Hagerty et al. ..... 83/464
3,848,501 11/1974 Kuts ..... 83/471.3
3,919,905 11/1975 Hoffman ..... 83/205
4,515,053 5/1985 DuBois ..... 83/488

*Primary Examiner*—Frank T. Yost
*Assistant Examiner*—Eugenia A. Jones
*Attorney, Agent, or Firm*—Fleit, Jacobson, Cohn & Price

[57] ABSTRACT

A dispenser for sheet material supplied in a spirally wound roll such as paper towels, or the like, in which the paper web is fed from the supply roll by an electrically driven feed roller and an opposed spring biased feed roller follower for gripping and feeding the paper web through a discharge slot in a housing. A reciprocating cutter assembly is mounted adjacent the discharge slot and feed roller which includes a carriage with an electrically driven rotary cutter blade mounted thereon with the carriage being guided by a guide structure and propelled transversely of the path of the paper web by an electrically powered cable and drum arrangement.

11 Claims, 4 Drawing Sheets

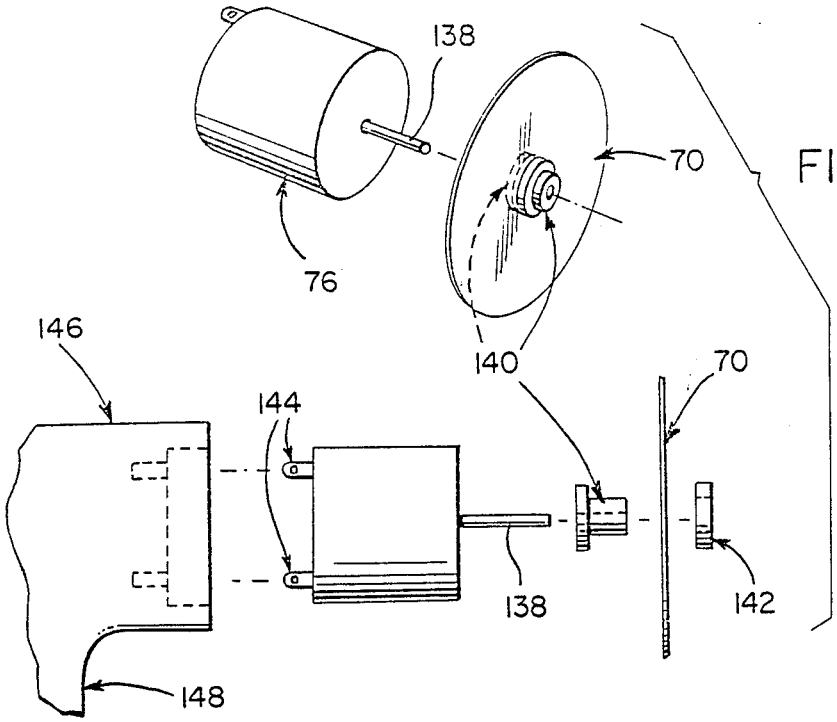
FIG. 7
FIG. 8
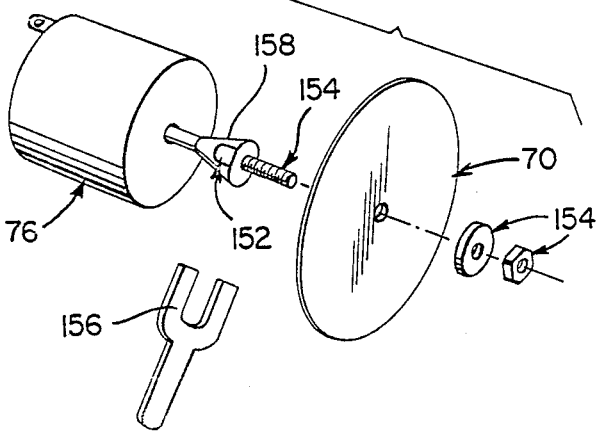
FIG. 10
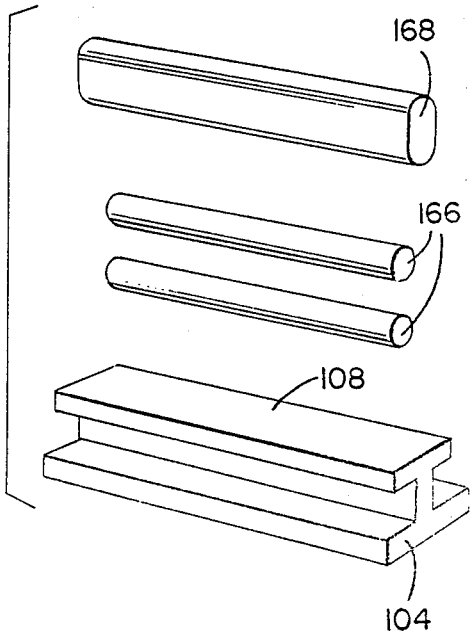
FIG. 9
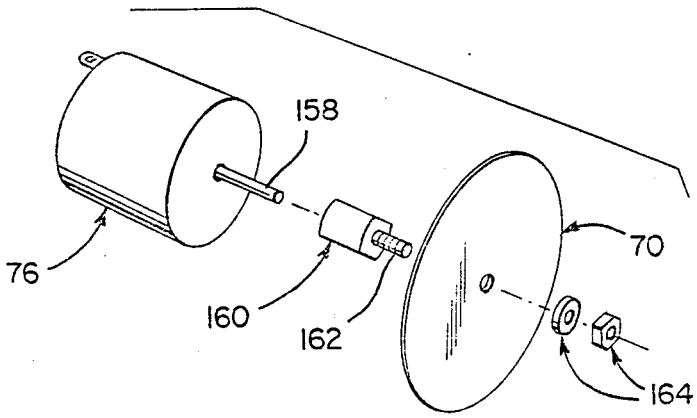

ELECTRICALLY POWERED DISPENSER FOR ROLLED SHEET MATERIAL HAVING A ROTARY BLADE CUTTER

BACKGROUND OF THE INVENTION

1. Field of the Invention

The present invention generally relates to a dispenser for sheet material supplied in a spirally wound roll such as paper towels, or the like, in which the paper web is fed from the supply roll by an electrically driven feed roller and an opposed spring biased feed roller follower for gripping and feeding the paper web through a discharge slot in a housing. A reciprocating cutter assembly is mounted adjacent the discharge slot and feed roller which includes a carriage with an electrically driven rotary cutter blade mounted thereon with the carriage being guided by a guide structure and propelled transversely of the path of the paper web by an electrically powered cable and drum arrangement.

2. Information Disclosure Statement

Paper web material such as paper towels and the like have been dispensed from a supply roll by using various structural arrangements. Usually the supply roll is rotatably supported so that when tension is exerted on the free end of the paper web, the paper web can be pulled outwardly with the supply roll rotating on a support structure so that a desired quantity, either fixed length or variable length, may be separated from the paper web for use. While various types of power operated dispensing devices are known, they are not the same as or equivalent to the structure disclosed in this application. A separate information disclosure statement will be filed.

SUMMARY OF THE INVENTION

An object of the present invention is to provide an electrically operated dispenser for paper towels or other sheet material in which a rotary cutter blade mounted on a carriage is moved transversely of the path of movement of the paper web for cutting the paper web at a desired point with the rotary cutter blade being independently powered by an electric motor and the carriage being reciprocated transversely of the path of movement of the paper web by an independent electric motor, guide rail assembly, cable and cable drum transport assembly.

Another object of the invention is to provide a dispenser in accordance with the preceding object in which the paper web is supplied in a spiral roll with the paper web extending between a feed roller and an opposed spring biased feed roller follower with the feed roller being independently powered for feeding a paper web through a discharge slot with the rotary cutter blade and its associated structure being disposed interiorly of a housing adjacent the discharge slot and feed roller.

A further object of the invention is to provide a paper web dispenser with rotary blade cutting assembly in which the feed roller is powered by an electric motor through a gear train in which the electric motor is housed in a hollow spool that telescopes into the core tube which supports one end of the paper roll to provide a compact structure.

Still another object of the invention is to provide a paper web dispenser in accordance with the preceding objects in which the driven feed roller is provided with a coating of rubber or similar resilient material with a plurality of axially spaced grooves therein receiving a blade or wiper structure conforming in shape therewith to preclude the paper web from wrapping around the feed roller thereby assuring that the paper web will be discharged through a discharge slot in a housing so that the rotary cutter blade can effectively cut the paper web at a desired point with the components of the assembly being controlled in a manner to provide proper sequential operation of the components.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 7 is a schematic view illustrating structural details of the rotary blade and motor.

FIG. 8 is a fragmental view of a different type of motor and assembly.

FIG. 9 is a fragmental view of another motor and blade structure.

FIG. 10 illustrates alternative guide rail structures for the carriage.

DESCRIPTION OF THE PREFERRED EMBODIMENT

Figure 1:
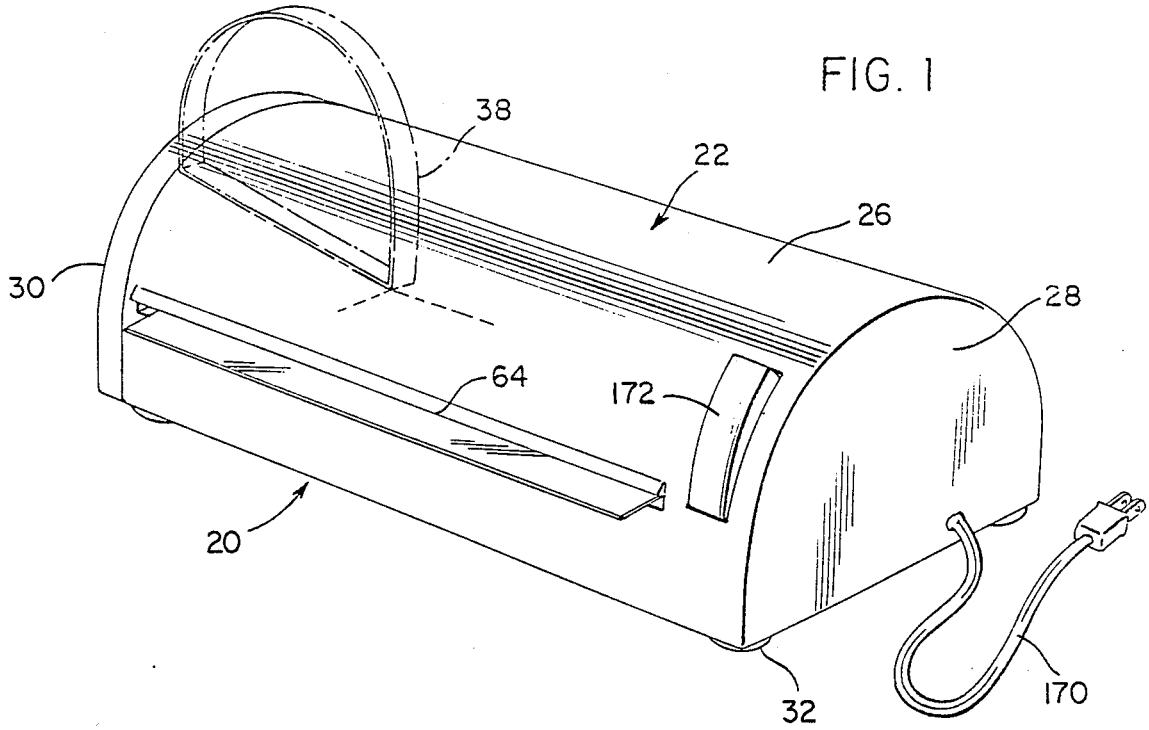
FIG. 1 is a perspective view of the dispenser of the present invention.

The dispenser of the present invention is generally designated by reference numeral 20 and includes a housing 22 having a generally flat, horizontal bottom wall 24 and a hollow upper wall 26 that includes a curved upper portion which may be oval shaped in configuration, symmetrical or any desired shape with the housing including end walls 28 and 30. The bottom wall 24 is provided with supporting pads or feet 32 adjacent the corners thereof by which the dispenser may be supported on a supporting surface such as a countertop in the kitchen or the like. The dispenser also may be constructed so that it can be supported in suspended relation by brackets under a kitchen cabinet or other supporting structures. The hollow interior of the housing 26 receives a roll of spirally wound sheet material 34 such as paper toweling, aluminum foil, plastic wrap, toilet tissue or other similar material which is provided with a tubular central core 36 of cardboard or similar material. The web of sheet material 34 may or may not be provided with tear off lines with the size and configuration of the housing 22 being sufficient to enable a full roll of sheet material 34 to be positioned therein through an open end of the housing formed by the end wall 30 being pivotally connected to the end of the housing by a hinge structure 38. The specific construction of the hinge 38 and latch structure to secure the end wall 30 in closed position enables the roll of sheet material to be easily inserted and replaced when desired.

Figure 4:
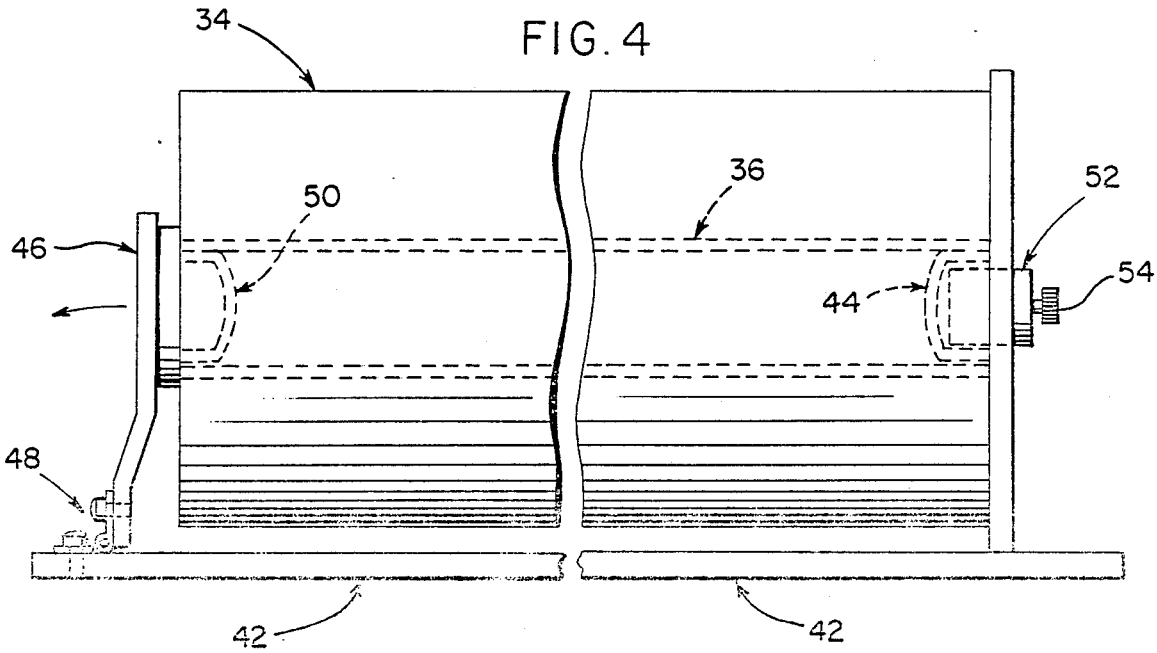
FIG. 4 is a fragmental elevational view of the paper roll spools and their association with the paper roll together with the association with a feed motor therewith.
Figure 3:
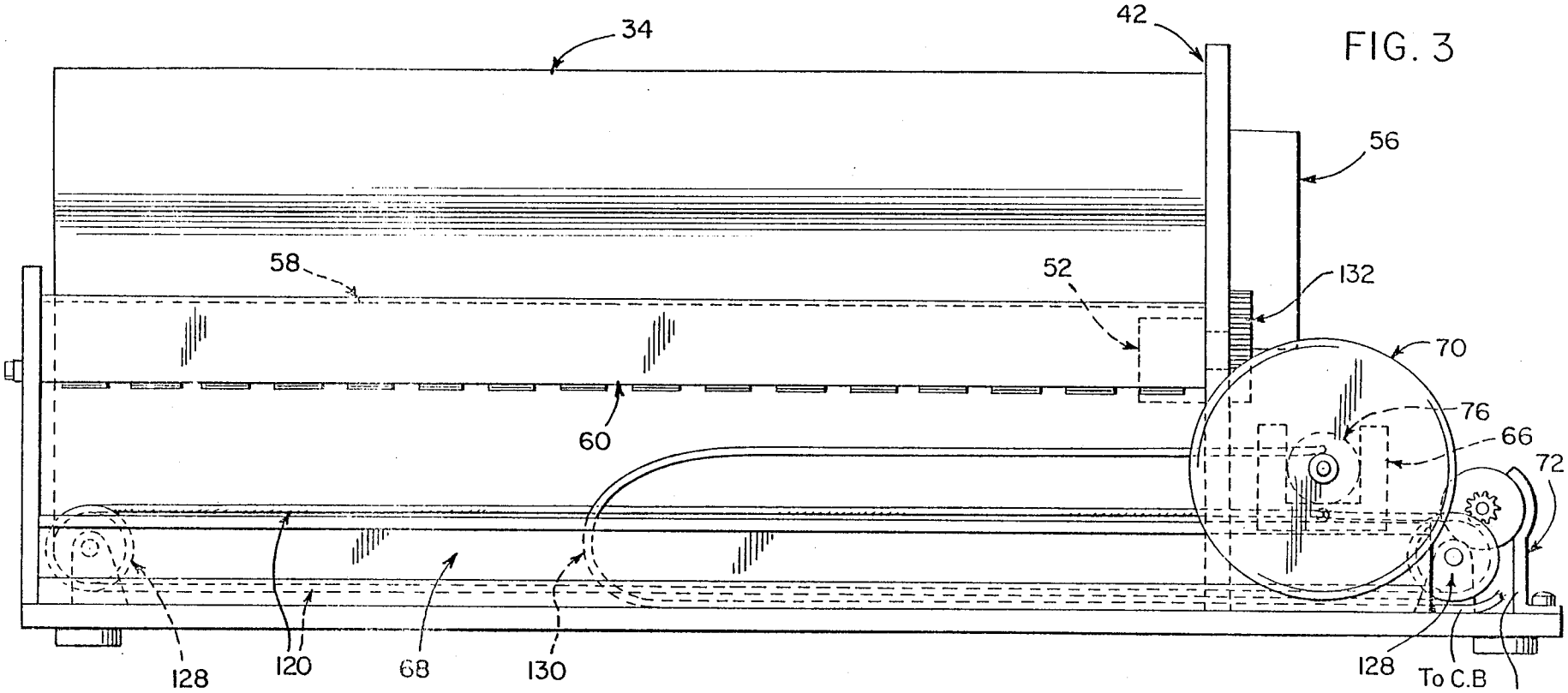
FIG. 3 is a longitudinal sectional view of the dispenser.

The interior of the housing 22 includes a support in the form of a wall or chassis 42 having a centrally disposed projecting, hollow spool 44 which partially telescopes into the hollow core 36 of a roll of sheet material 34. Also, the pivotal end wall 30 covers a pivotal support member 46 that is hingedly connected to the bottom wall 24 by a spring hinge 48 with this member also being provided with a hollow spindle 50 in engagement with the opposite end of the core 36 of the roll of web material 24 so that the roll of web material will have a degree of frictional resistance to free rotational movement. As illustrated in FIG. 4, the chassis or wall 42 and the paper supporting spool 44 partially receives a paper feed motor 52 having an output pinion gear 54 in meshing engagement with a gear train or other drive train generally designated by numeral 56 as illustrated in FIG. 3. Thus, by pivoting the end wall 30 and the support member 46, a supply roll of paper web material 34 may be inserted into the dispenser.

Figure 2:
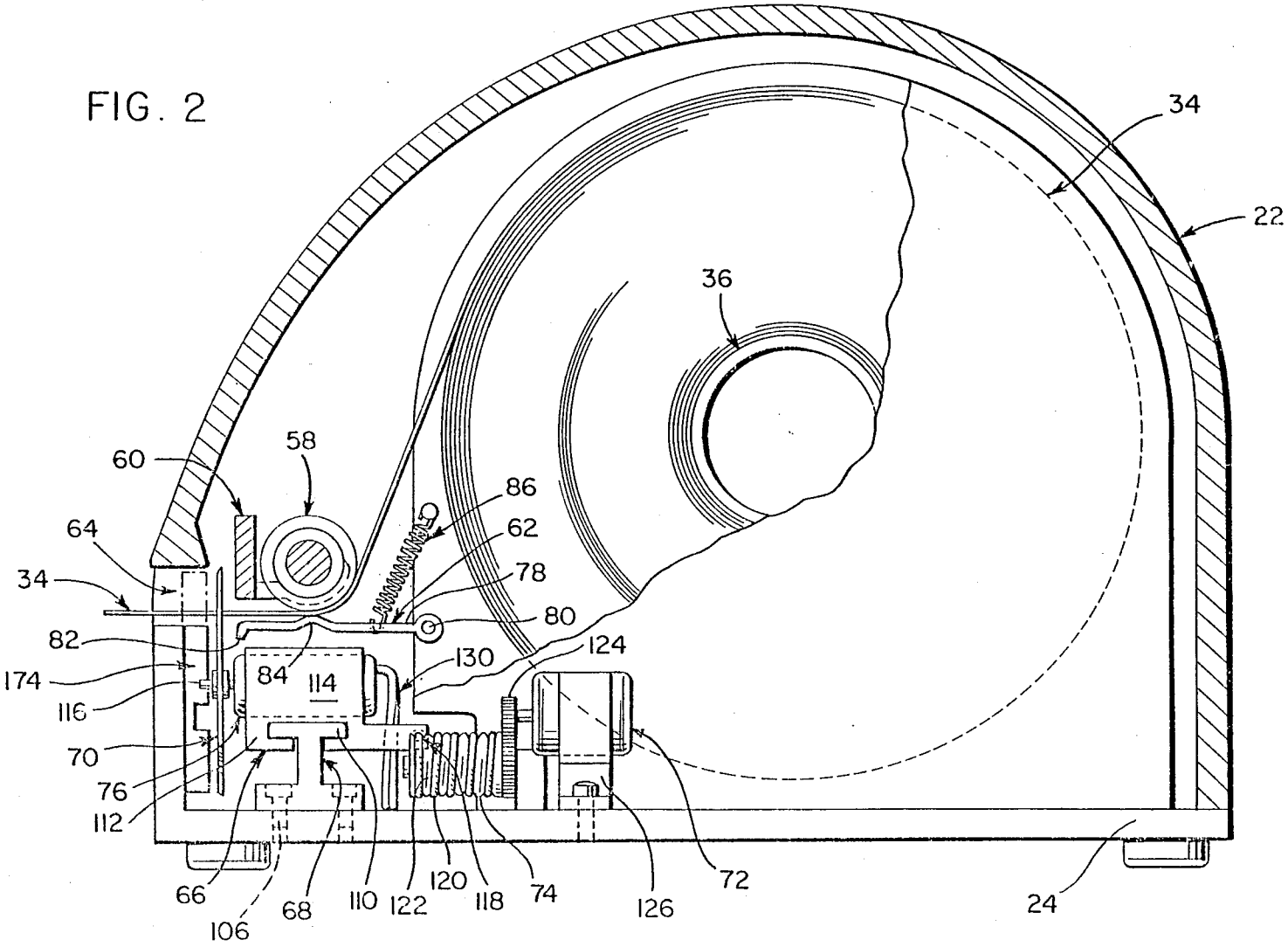
FIG. 2 is a transverse sectional view of the dispenser illustrating the structure and relationship of the components.

The drive train 56 reduces the output speed from the motor for driving a feed roller 58 at a reduced speed. The feed roller is oriented in parallel relation to the supply roll of paper web material 34 as illustrated in FIG. 2 with the rotational center of the roller 58 being disposed horizontally below the rotational center of the roll of paper web material 34 so that the paper coming off of the paper roll will extend downwardly and under the feed roller 58 which has a wiper structure 60 associated therewith and a roller follower 62 associated therewith with the follower being located below the roller 58 and the roller wiper 60 being located against the surface of the roller 58 remote from the paper web material 34. With this construction, the paper web 34 will be discharged through a discharge slot 64 in the housing 22 with the discharge slot 64 being spaced upwardly from the bottom wall 24 as illustrated in FIG. 2.

Mounted below the feed roller 58 is a carriage 66 mounted on a carriage guide or transport rail 68 for lateral or transverse movement in relation to the housing with these components being oriented so that a rotary circular cutter blade 70 mounted on the carriage 66 will cut the paper web 34 immediately inwardly of the discharge slot 64 when the feed roller 58 is stopped and the rotary blade 70 is driven and the carriage 66 moved transversely of the path of movement of the paper web. A carriage drive motor 72 laterally reciprocates the carriage 66 through a drum and cable drive assembly 74 and the rotary cutter blade 70 is powered by an electric motor 76 secured to the carriage 66.

The roller follower 62 includes a pair of arms 78 pivotally supported by pivot pins 80. The arms 78 are interconnected by a plate-like structure having an upwardly offset portion 82 in opposed relation to the lowermost periphery of the feed roller 58 as illustrated in FIG. 2 with the outer end of the plate being down turned at 84 so that the paper web will be frictionally and resiliently gripped between the feed roller 58 and the feed roller follower 62 with a tension spring 86 connected to each of the arms for biasing the roller follower 62 towards the feed roller 58.

Figure 12:
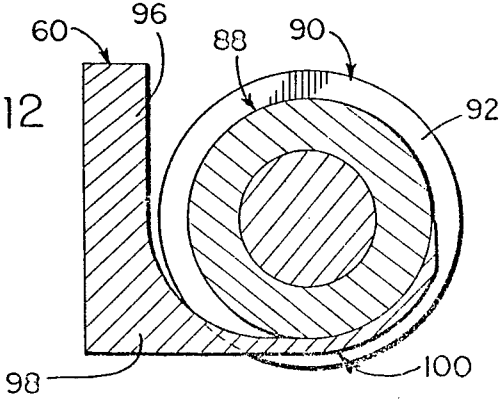
FIG. 12 is a sectional view of the roller wiper and feed roller structure.
Figure 11:
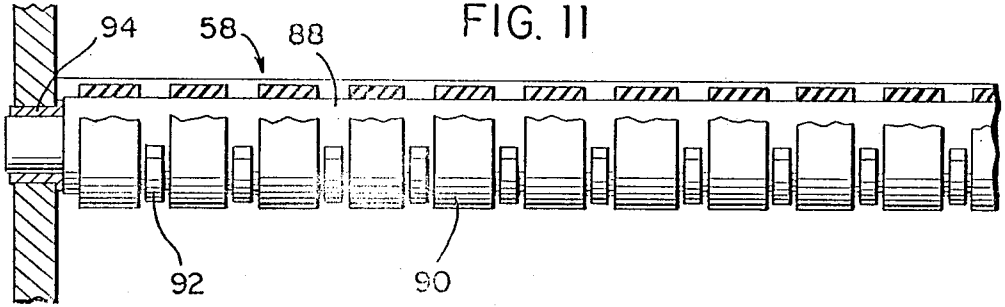
FIG. 11 is a detailed side elevational view of the feed roller with portions broken away.

The feed roller 58 includes a roller shaft 88 having a coating of rubber or similar resilient material 90 thereon with grooves 92 being formed in the rubber coating throughout the length of the roller with the grooves being relatively narrow as compared to the rubber coating between the grooves. The ends of the shaft 88 are journalled in bearing structures 94 in support members 42 and 46. The roller wiper 60 includes a vertical blade structure 96 which includes a laterally extending lower end 98 that includes extending tines 100 which are received in the grooves 92 and extend for a substantial portion of the bottom periphery of the roller shaft with the terminal end of the tines 100 being tapered as at 102 and generally being in horizontal alignment with the rotational axis of the roller shaft 88 as illustrated in FIG. 12 so that the paper web 34 passing under the feed roller 58 will contact the outer periphery of the rubber coating 90 with the tines or fingers assuring that the paper web will not wrap around the roller shaft 88 thereby preventing any possibility of the dispenser being jammed due to the paper web wrapping around the roller.

The carriage guide or transport rail 68 has a transverse configuration similar to an I-beam as illustrated in FIG. 2 and also as illustrated in FIG. 10 with the bottom rail 104 being secured to the bottom wall 24 by fasteners 106 and the upper flange 108 slidably receiving a correspondingly shaped recess 110 in the carriage body 112 which includes a clamp sleeve or other suitable mounting structure 114 for securing the blade motor 76 to the carriage body 112. The carriage motor 76 includes an output shaft 116 supporting the circular blade 70 so that it moves transversely between the discharge slot 64 and the roller wiper 60 as illustrated in FIG. 2 with the upper periphery of the rotary blade 70 being disposed above the top edge of the slot 64 to assure that the paper web 34 will be cut when the carriage moves transversely along the rail 68 from an at rest position to a position at the other end of the rail. The carriage body 112 includes an extension 118 having the cable 120 of the drum and cable assembly 74 connected thereto with the cable being wound on and secured to a drum 122 which is driven by a gear drive assembly 124 from the carriage drive motor 72 secured to the bottom wall 24 by a suitable bracket structure 126. The cable 120 is entrained over pulleys 128 at each end of the guide rail and is connected to the extension 118 so that the reversable carriage drive motor 72 may reciprocate the carriage and blade across the path of movement of the paper web. As an alternative to the cable and drum carriage drive, a toothed timing belt, drive gear and pulleys may be used which provides a simplified structure. The blade motor 76 is supplied electrical energy through a power cord 130 which lies along the surface of the bottom wall in a manner similar to such power cords used in various types of typewriter and computer printer carriages.

Figure 5:
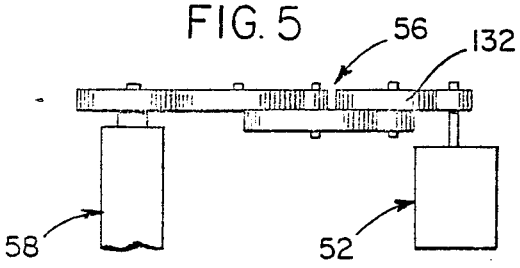
FIG. 5 is a schematic view of the gear-type drive train between the feed motor and feed roller.
Figure 6:
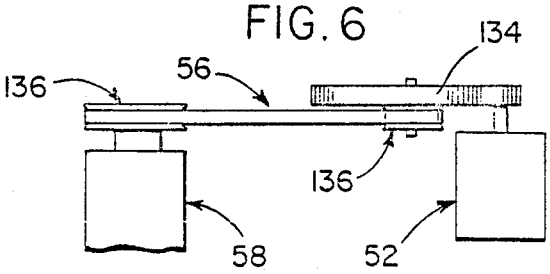
FIG. 6 is a schematic view of a belt-type drive train between the feed motor and feed roller.

FIG. 5 illustrates the gear train 56 as involving a plurality of meshed gears 132 between the paper feed motor 52 and the paper feed roller 58 whereas FIG. 6 illustrates a drive train 56 which includes a combination of a gear set 134 and a timing belt and pulley drive 136 interconnecting the paper feed motor 52 and the paper feed roller 58.

FIG. 7 illustrates the rotary cutter blade 70 and blade motor 76 in which the output shaft 138 of a motor 76 extends through a hub 140 with a retaining ring 142 permanently securing the blade and hub together so that the motor and blade assembly may be replaced as a unit. In this construction, the motor includes a pair of contacts or leads 144 projecting from the end thereof remote from the shaft 138 with the motor being telescoped into a socket 146 which has female contacts 148 associated therewith to supply electrical energy to the motor when the motor is plugged into the socket.

FIG. 8 illustrates another embodiment of the blade motor 76 in which the output shaft 150 includes a hub 152 thereon with a threaded extension 154 with the blade 70 being secured in place by a washer and nut assembly 154 with the nut and hub including flats for receiving a Y-shaped wrench or wrenches 156.

FIG. 9 illustrates another motor assembly including the motor 76 having an output shaft 158 having a threaded hub 160 with flats frictionally pressed thereon with the hub 160 including a threaded shaft 162 extending through the blade 70 with the washer and nut assembly 164 securing the blade in position in the same manner as FIG. 8.

FIG. 10 illustrates alternative guide rail structures including a pair of parallel, spaced guide rails 166 which slidably support the carriage in the same manner as the rail 68 and also a single rail 168 which is oval shaped in transverse configuration with it being pointed out that various polygonal shapes may be employed so that the rotational axis of the cutter blade 70 will remain substantially horizontal with the blade being disposed substantially vertical.

As illustrated in FIG. 1, the dispenser 20 is supplied with electrical energy from a conventional cord 170 having a conventional plug thereon and an arcuate actuating switch 172 is mounted on the housing 22 adjacent the end thereof having the feed roll motor associated therewith for actuation of the dispenser.

The rotary cutting blade 70 may vary in structural characteristics but a circular blade having a diameter of approximately 2" and a thickness ranging between 0.005" and 0.015" has been found satisfactory and, as indicated, the blade may be connected to the motor shaft in several different ways and the motor may be a sub-assembly along with the blade that is plugged into a socket arrangement. The carriage 66 slides on the guide rail structure such as the beam configurations and arrangements illustrated in FIG. 2 and in FIG. 10. The power cord 130 to the blade motor 76 is a flexible flat or ribbon wire which is stored along the bottom of the chassis and travels with the carriage as it traverses across the paper web with the power cord arrangement being similar to those used in typewriter carriages, computer printer carriages and the like. The carriage drive motor gear drives the drum through a reduction gear arrangement with the cable being fastened to the drum and provided with turns around the drum, preferably four to seven turns and then extends across the front of the machine and around idler pulleys and back to and attached to the drum with the carriage drive cable being fastened to the carriage as illustrated in FIG. 2.

The paper roll is held in stored and aligned position by the spools 44 and 46 and the paper feed motor 52 is mounted partially inside the spool 44 as illustrated in FIG. 4 and the output gear 54 on the motor 52 meshes with the input gear of the drive train 56 regardless of whether the drive train is a gear train as illustrated in FIG. 5 of a gear and timing belt drive train as illustrated in FIG. 6. As illustrated, the paper holding spools 44 and 46 are smaller than the paper towel core 36 with one of the spools being mounted on a spring loaded support member or arm 46 supported by the hinge 48 so that the support member or arm 46 can be swung downwardly or outwardly when the end wall 30 is opened to provide access for positioning the paper roll on the spool for replacement of the paper roll when necessary. The panel or wall 42 has the spool 44 mounted thereon or integral therewith is larger than the paper roll to help align a roll of paper towel onto the spool 44. Both of the spools 44 and 50 have rounded inner ends to facilitate guiding them into the paper towel core 36.

In order to operate the dispenser, the large switch actuator 172 on the exterior of the housing is depressed. If the switch actuator 172 is only momentarily pushed inwardly or tapped, a predetermined length of paper towel will be dispensed and cut. Otherwise, the sheet of paper dispensed will be determined by the length of time that the switch actuator 172 is depressed.

As soon as the switch actuator 172 is depressed, the blade motor 76 is energized thus rotating the blade to provide time for the blade to build up speed as the paper is being dispensed so that when the desired length of paper towel has been dispensed and the feed motor stops, the blade motor carriage can be traversed across the paper immediately thereby eliminating any need for time to build up RPM by the blade. Also, as indicated, depression of the switch actuator 172 also actuates the feed motor 52 thus actuating the feed roller 58 with the length of the paper dispensed through the discharge slot being determined by the manner of actuation of the switch actuator 172.

When the carriage 66, motor 76 and blade 70 have traversed from an initial at rest position all the way across the paper, a limit switch will be actuated that sends a signal to a circuit arrangement on a circuit board that reverses the carriage motor 72 to move the carriage back across the paper until it closes a limit switch at its original position which stops the carriage in its initial or ready position ready for paper to be dispensed again when the actuator 172 is depressed.

As the paper feed motor 52 is actuated, paper 34 is fed between the paper drive roller 58 and the roller follower 60 through the output slot or paper exit opening 64. The paper is kept from jamming the paper drive roller by the roller wiper 60 which has protrusions or fingers 100 that contact the roller shaft 88 in the grooves or slots 92 in the rubber coating 90 on the roller shaft 88. This structure prevents the paper 34 from following the feed roller and assuring that the paper will be guided through the exit opening 64.

As illustrated in FIG. 2, a safety door 174 may be associated with the exit slot 64 to prevent injury from the cutting blade with the door closing the slot 64 when being elevated and opening the slot 64 when lowered with the door being positioned between the rotary blade 70 and the wall defining the lower edge of the slot. The safety door 174 may be raised and lowered by a motor or solenoid and controlled in a manner that when the door is open, the carriage cannot travel across the path of movement of the paper. FIG. 2 shows the door in open position as paper is dispensed and when the feed motor stops the door 174 will be moved to closed position which permits clearance for the motor shaft and carriage assembly to travel across the path of movement of the paper. Actuation of the door may be accomplished by the use of a normally open switch in series with the carriage motor so that the switch is closed when the door closes the paper exit opening. Alternatively, a mechanical interference structure may be employed so that when the safety door is open, the carriage path is blocked by the door as shown in FIG. 2 since the door in FIG. 2 is lowered and blocks movement of the motor shaft 116 thereby blocking movement of the carriage, motor and rotary blade. A circuit board with control circuits associated therein may be conveniently mounted interiorly of the housing with the limit switches for the carriages also being conveniently mounted in an adjustable manner to assure proper operation of these components. Since these components are substantially conventional in construction, the details thereof have not been illustrated.

The foregoing is considered as illustrative only of the principles of the invention. Further since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A dispenser for rolled sheet material comprising a hollow housing, means in the housing to rotatably support a roll of sheet material, said housing including a discharge slot through which a web of sheet material can be discharged, means in said housing to move a web of material through the discharge slot, and means in said housing for cutting the web of material adjacent to but spaced from the discharge slot, said cutting means comprising a carriage movable transversely of the web of material, a motor mounted on the carriage and including an output shaft, a rotary circular cutting blade mounted on the output shaft with the periphery of the blade engaging and cutting the web of material when the carriage is moved transversely of the path of movement of the web of material, said means in the housing to move a web of material including a feed roller engaging one surface of the web of material, a feed roller follower engaging the opposite surface of the web of material in opposed relation to the feed roller with the feed roller follower being a plate-like member having an upwardly offset portion engaging the web of material, said follower being pivotally mounted and spring biased toward the feed roller, a feed roller drive motor connected to the feed roller through a reduction drive train, and a feed roller wiper engaged with the periphery of the feed roller in spaced relation to the follower to prevent the web of material from wrapping around the feed roller.

2. The dispenser as defined in claim 1 wherein said carriage includes a body, stationary guide rail means mounted in said housing supporting and guiding the carriage body for reciprocatory movement transversely of the path of movement of the web of material, a carriage drive motor and carriage transport means connected with the carriage drive motor and the carriage for moving the carriage transversely.

3. The dispenser as defined in claim 2 wherein said carriage drive motor is reversable to move the carriage in a reciprocatory manner transversely of the path of movement of the web of material, said carriage transport means including a rotary drum driven by the carriage drive motor, a cable wound on and attached to the drum, idler pulleys mounted adjacent the ends of the guide rail means in alignment with the carriage and drum with the cable entrained over the pulleys and having a mid-portion connected with the carriage for moving the carriage upon actuation of the carriage drive motor.

4. The dispenser as defined in claim 1 wherein said feed roller is rotatably supported in spaced parallel relation to the roll of sheet material in the housing and includes a resilient coating on the exterior surface thereof with axially spaced grooves being formed in the resilient coating, said wiper including a plurality of fingers inserted into the grooves between the surface of the web of material engaged by the feed roller and the inner surface of the grooves, said wiper and fingers being disposed adjacent the feed roller and between the feed roller and discharge slot with the fingers extending into the grooves from the discharge side of the roller to prevent the web of material from wrapping around the feed roller.

5. The dispenser as defined in claim 4 wherein said means to support a roll of sheet material including a pair of hollow spindles telescoped into the end portions of a web core, said feed roller drive motor being partially received in one of the hollow spindles for compact construction.

6. The dispenser as defined in claim 2 wherein said guide rail means for the carriage includes a single guide rail having a generally T-shaped flange configuration along its upper edge with the carriage including a correspondingly shaped recess to provide accurate and controlled reciprocation of the carriage.

7. The dispenser as defined in claim 2 wherein said guide rail means includes at least one guide rail having a non-circular cross-sectional configuration for guiding and stabilizing the carriage.

8. The dispenser as defined in claim 2 wherein said guide rail means includes a pair of spaced rails for guiding and stabilizing the carriage.

9. The dispenser as defined in claim 2 wherein said blade motor and blade are interconnected to form a sub-assembly with the motor including projecting contacts for telescopic insertion into a motor receiving socket having female contacts therein to enable replacement of the motor and blade as a sub-assembly.

10. The dispenser as defined in claim 1 together with a vertically reciprocating safety door mounted in the housing inwardly of the discharge slot for closing the discharge slot when the rotary clutter blade is moved transversely of the path of movement of the web of material thereby preventing access to the rotary cutter blade when it is moving transversely between the ends of the slot.

11. A dispenser for sheet material spirally wound into a roll comprising a housing having a discharge slot, means interiorly of the housing to rotatably support a roll of sheet material with the free end of the sheet material being extendable outwardly through the discharge slot, means oriented internally of the housing for feeding sheet material from the supply roll through the discharge slot and means in said housing to cut the sheet material transversely between the feed means and discharge slot by which a predetermined length of sheet material may be severed, said feed means including a driven feed roller positioned parallel to the discharge slot and roll of sheet material with the sheet material engaging a substantial circumferential portion of the feed roller as the sheet material passes under the feed roller, said feed roller including a resilient peripheral surface for gripping engagement with the sheet material, a feed roller follower positioned below the feed roller and engaging the sheet material in opposed relation to surface of the feed roller, said follower being in the form of a pivotally mounted plate-like member having an upwardly offset portion engaging the undersurface of the sheet material at a transverse area generally aligned with the rotational axis of the feed roller with the follower and feed roller cooperating to frictionally grip the sheet material for pulling it off of the supply roll and discharging it through the discharge slot, a feed roller wiper disposed above the sheet material and oriented between the feed roller and discharge slot, said feed roller including peripheral grooves and said wiper including fingers extending downwardly under the feed roller and curving upwardly and terminating in tapered free ends above the point of engagement of the sheet material with the feed roller as it approaches the feed roller with the fingers being received in the grooves in the feed roller to assure that the sheet material will not wrap around the feed roller, said wiper including a downwardly facing generally horizontal surface extending from the feed roller toward the discharge slot to guide sheet material into the discharge slot, said means for cutting the sheet material including a carriage in the housing, means supporting the carriage for reciprocatory movement parallel to the discharge slot and adjacent thereto and between the discharge slot and wiper, a cutter blade mounted on the carriage in underlying relation to the sheet of material for cutting the sheet of material from the undersurface thereof, means moving the carriage in a reciprocating manner in relation to the housing and discharge slot, said cutter blade being a circular blade, a motor on the carriage having an output shaft connected to the circular blade for driving the blade independently of the means to move the carriage, said housing including a movable closure door for the discharge slot during the cutting operation to prevent accidental contact with the rotary blade.

* * * * *